US007611042B2

(12) United States Patent
Bates et al.

(10) Patent No.: US 7,611,042 B2
(45) Date of Patent: Nov. 3, 2009

(54) CARTON AND BLANK FOR EXPANDABLE CARTON

(75) Inventors: Aaron Bates, Powder Springs, GA (US); Michael Scrimger, Grandville, MI (US); Jean-Michel Auclair, Chateauroux (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 691 days.

(21) Appl. No.: 11/218,130

(22) Filed: Sep. 1, 2005

(65) Prior Publication Data

US 2006/0081690 A1 Apr. 20, 2006

Related U.S. Application Data

(60) Provisional application No. 60/606,450, filed on Sep. 1, 2004.

(51) Int. Cl.
*B65D 17/28* (2006.01)

(52) U.S. Cl. ..... 229/101; 206/427; 229/138; 229/223

(58) Field of Classification Search ..... 229/101, 229/138, 222, 223; 206/427; 62/457.1, 457.2, 62/457.4, 457.5
See application file for complete search history.

(56) References Cited

U.S. PATENT DOCUMENTS

| | | | | | |
|---|---|---|---|---|---|
| 2,377,125 | A | | 5/1945 | Borah et al. | |
| 2,810,506 | A | | 10/1957 | Kessler | |
| 3,176,904 | A | * | 4/1965 | Collura | 229/222 |
| 3,346,399 | A | * | 10/1967 | Watson et al. | 426/111 |
| 3,502,488 | A | * | 3/1970 | Bridgford | 229/138 |
| 3,581,977 | A | * | 6/1971 | Kirsky et al. | 229/138 |
| 3,886,901 | A | * | 6/1975 | Zeitter | 229/101 |
| 4,101,052 | A | * | 7/1978 | Dove | 229/101 |
| 4,111,306 | A | * | 9/1978 | Roccaforte | 229/240 |
| 4,272,009 | A | * | 6/1981 | Bamburg et al. | 229/101 |
| 4,328,923 | A | | 5/1982 | Graser | |
| 4,340,169 | A | * | 7/1982 | Webinger | 229/101 |
| 4,974,731 | A | | 12/1990 | Wood | |
| 4,979,666 | A | * | 12/1990 | Zion et al. | 229/101 |
| 5,020,337 | A | | 6/1991 | Krieg | |
| 5,101,642 | A | | 4/1992 | Alexandrov | |

(Continued)

FOREIGN PATENT DOCUMENTS

| | | |
|---|---|---|
| EP | 0 507 941 B1 | 2/1995 |

(Continued)

*Primary Examiner*—Gary E Elkins
(74) *Attorney, Agent, or Firm*—Tsugihiko Suzuki

(57) ABSTRACT

A blank for forming a carton of the end loading type for containing a plurality of beverage cans, the capacity of the carton can be increased to accommodate the insertion of ice-cubes into the carton for cooling the beverage cans contained therein, the blank for forming the carton, including a series of main panels including at least one top panel, one of the top panels having a tear strip and thereby being separable into two parts, the blank further including end extension panels, wherein upon constructing the blank into the set up carton, separating the top panel, by deploying the tear strip, allows each end extension panel and each of the separated parts of the top panel to be raised above the tops of the beverage cans to increase the capacity of the carton to accommodate the insertion of ice cubes.

14 Claims, 8 Drawing Sheets

U.S. PATENT DOCUMENTS

| | | | |
|---|---|---|---|
| 5,170,934 | A | 12/1992 | Lemoine |
| 5,284,294 | A | 2/1994 | Floyd |
| 5,303,863 | A | 4/1994 | Arasim |
| 5,307,986 | A | 5/1994 | Schuster |
| 5,427,308 | A | 6/1995 | Swift et al. |
| 5,495,727 | A | 3/1996 | Strong et al. |
| 5,582,343 | A | 12/1996 | Dalvey |
| 5,853,121 | A | 12/1998 | Francisco |
| 6,164,526 | A | 12/2000 | Dalvey |
| 6,631,803 | B2 | 10/2003 | Rhodes et al. |

FOREIGN PATENT DOCUMENTS

| | | |
|---|---|---|
| EP | 1 034 112 B1 | 4/2002 |

* cited by examiner

CARTON AND BLANK FOR EXPANDABLE CARTON

This application claims the benefit of Provisional Application No. 60/606,450 filed Sep. 1, 2004.

BACKGROUND OF THE INVENTION

The present invention relates to a carton and a blank for forming the carton for containing a plurality of articles and in particular to a carton, the capacity of which can be increased to accommodate additional items.

Cartons for encasing multiple articles are useful for enabling consumers to obtain and transport a desired quantity of individual articles such as soft drinks or other beverages. Such cartons need to be strong enough to support multiple articles, especially if the articles are bottles. It is also desirable for such cartons to be easy to handle and portable. It is also useful for the consumer to be able to add ice-cubes into such a carton in order to cool the beverage cans or bottles contained within the carton. It is therefore desirable for such cartons to be substantially water resilient so that once the ice-cubes have melted the carton structure remains substantially intact and does not allow the water to readily leak from the carton. It is also often desirable for the cartons to be adaptable so that the capacity of the carton can be increased to accommodate the addition of ice-cubes.

Such cartons are known in the art, one such carton is disclosed in U.S. Pat. No. 6,631,803, which provides a beverage cooler box for bottles which is intended to receive ice cubes and is made of a material which is impervious to liquid. However, the carton of U.S. Pat. No. 6,631,803 does not provide a means for increasing the capacity of the carton to accommodate the addition of ice cubes and so the carton is limited in the number of ice cubes which it can receive.

A carton for packaging articles having additional side and end panels which can be unfolded to provide additional capacity to the carton is disclosed in U.S. Pat. No. 5,020,337. In U.S. Pat. No. 5,020,337 the carton comprises an array of panels to fully enclose the bottom to maintain a water tight base, a series of side and end walls, additional panels to extend the size of the carton and two top panels. Whilst U.S. Pat. No. 5,020,337 provides a carton which can accommodate the addition of ice cubes and maintain a water tight base, a considerable quantity of material is required to form the carton. Furthermore the structure and arrangement of the water tight base of the carton disclosed in U.S. Pat. No. 5,020,337 limits the carton to being top loaded and it is often desirable for cartons to be end loaded. It is also often desirable for the blanks from which such cartons are constructed to be symmetrical as the blanks can be erected in a straight line machine and are not necessarily required to be rotated during the construction process, this is not the case with the blank of U.S. Pat. No. 5,020,337.

It is therefore an objective of the present invention to provide a carton and blank for forming the carton, that overcomes or at least reduces the problems of the abovementioned prior art.

SUMMARY OF THE INVENTION

According to a first aspect of the present invention, a carton of the end loading type for containing a plurality of similar articles, being structured such that the capacity of the carton can be increased when opened, the carton comprising a series of main panels hinged one to the next, including a bottom panel, first and second side panels and at least one top panel, one of the top panels having a tear strip and thereby being separable into two parts, said top panel being hinged at each end thereof to at least a portion of an end extension panel, the carton further comprising a top end closure panel hinged to each end extension panel and bottom and side end closure panels hinged to opposing ends of the bottom and side panels, characterised in that the end extension panels are disposed beneath the or each top panel and in that separating the top panel, by deploying the tear strip, allows each end extension panel and each of the separated parts of the top panel to be raised into substantially the same plane as respective adjacent side and end walls, thereby increasing the capacity of the open carton.

Preferably the carton may comprise two top panels, each of the top panels being hinged to one of the side panels. Additionally each end of each top panel may be hinged to a portion of an end extension panel and each portion may be secured to a second portion to form two composite end extension panels.

Preferably each composite end extension panel is hinged to a top end closure panel and each top end closure panel may be formed from two portions.

Additionally the carton may further comprise a handle aperture formed in each end extension panel for carrying the opened carton. Alternatively each bottom end closure panel may comprise a handle aperture for carrying a set up carton.

Preferably the carton is formed from a sheet material, one side of which may be coated with a water resilient coating. The carton may be substantially water tight.

According to a second aspect of the invention there is provided a blank for forming a carton of the end loading type, the carton may be for containing a plurality of similar articles and being structured such that the capacity of the carton can be increased when opened, the blank comprising a series of main panels hinged one to the next, including a bottom panel, first and second side panels and at least one top panel, one of the top panels having a tear strip and thereby being separable into two parts, said top panel being hinged at each end thereof to at least a portion of an end extension panel, the blank further comprising a top end closure panel hinged to each end extension panel and bottom and side end closure panels hinged to opposing ends of the bottom and side panels, characterised in that the end extension panels are disposed beneath the or each top panel when the carton is set up and in that separating the top panel, by deploying the tear strip, allows each end extension panel and each of the separated parts of the top panel to be raised into substantially the same plane as respective adjacent side and end walls, thereby increasing the capacity of the open carton.

Preferably the blank may comprise two top panels, each of the top panels being hinged to one of the side panels.

Additionally each end of each top panel may be hinged to a portion of an end extension panel wherein upon constructing the blank into a set up carton each portion may be secured to a second portion to form two composite end extension panels.

Preferably each portion of the end extension panel may be hinged to a portion of a top end closure panel wherein upon constructing the blank into a set up carton each portion of the top end closure panels is secured to a second of the portions to form two composite top end closure panels.

Preferably the blank may comprise a handle aperture in each end extension panel for carrying the opened carton.

Alternatively each bottom end closure panel may comprise a handle aperture for carrying a set up carton.

Preferably one side of the blank may be coated with a water resilient coating. Additionally the carton formed may be substantially water tight.

BRIEF DESCRIPTION OF THE DRAWINGS

Two exemplary embodiments of the invention will now be described, by way of example only, with reference to the accompanying drawings in which.

DETAILED DESCRIPTION OF THE PREFERRED EMBODIMENTS

Figure 1:
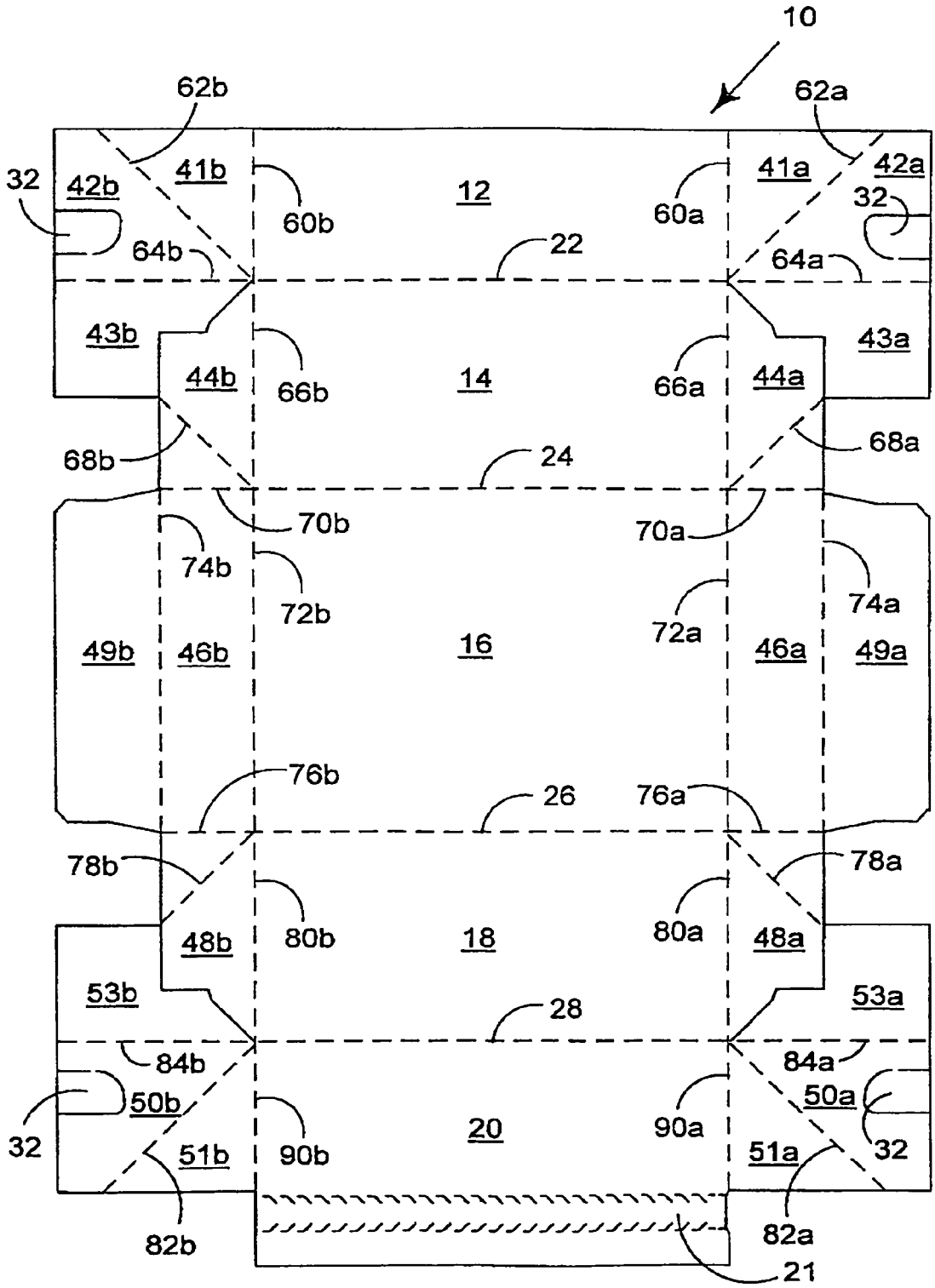
FIG. 1 shows a blank, according to a first embodiment of the invention, for forming a carton for containing cans.
Figure 4:
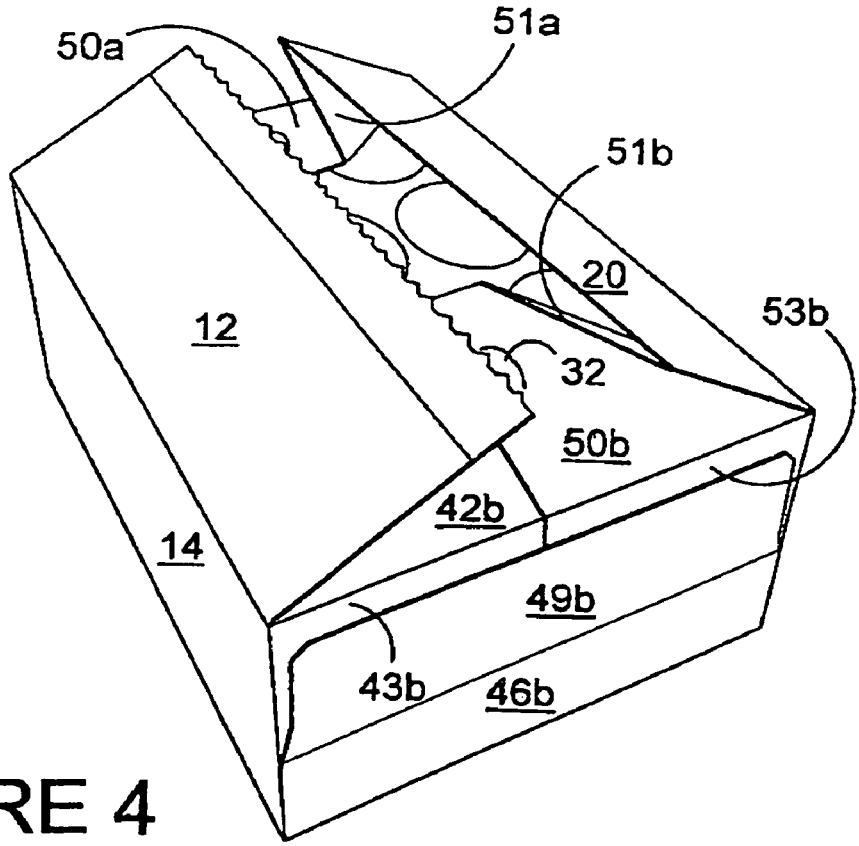
FIG. 4 shows the carton of FIG. 3 with a tear strip removed and the top of the carton being partially open.

As shown in FIG. 1, a first embodiment of the present invention provides a blank 10 from which a carton 40, which is shown in FIG. 4, is formed. The blank 10 is vertically elongate as viewed in FIG. 1 and is formed of paperboard which is provided with a water resilient coating on at least one surface. The blank 10 may be formed of other foldable material such as a plastic sheet or the like. The blank 10 of this embodiment is designed for packaging beverage cans, arranged in four rows of three cans each. It is envisaged that other articles and/or different numbers of articles may be contained within the carton and that the blank may therefore be sized accordingly.

The blank 10 comprises a series of main panels including a first top panel 12, first side panel 14, bottom panel 16, second side panel 18 and second top panel 20. The main panels are hinged one to the next in series along fold lines 22, 24, 26 and 28, as illustrated in FIG. 1. The blank 10 further comprises a series of end closure panels hinged to opposed ends of each of the main panels for closing the ends of the carton.

Since the blank 10 is symmetrical, the end closure panels on only one side of the blank will be described, it being understood that the other side is identical. The first top panel 12 is hinged to a first gusset panel 41*a* along fold line 60*a*. The first gusset panel 41*a* is in turn hinged to a second gusset panel 42*a* along fold line 62*a*, the second gusset panel being hinged to a first part of a top end closure panel 43*a* along fold line 64*a*. The second gusset panel 42*a* also comprises a handle flap 32 which is defined by an interrupted scoreline. Together the first and second gusset panels 41*a*, 42*a* form part of an end extension panel.

The first and second side panels are each provided with side end closure panels 44*a* and 46*a* which are hinged to the unconnected edges of the first and second side panels along fold lines 66*a* and 80*a* respectively. Each of the side end closure panels 44*a*, 48*a* have an intersecting fold line 68*a*, 78*a*. A two part bottom end closure panel 46*a*/49*a* is hinged to the bottom panel 16 along a fold line 72*a*. The bottom end closure panel is also hinged to each of the side end closure panels 44*a*, 48*a* along fold lines 70*a* and 76*a*. In this embodiment of the invention the two parts of the bottom end closure panel 46*a*/49*a* are separated by a fold line 74*a*.

The second top panel 20 is provided with a tear strip 21 and is hinged to a first gusset panel 51*a* along fold line 90*a*. The first gusset panel is in turn hinged to a second gusset panel 50*a* along fold line 82*a*. The second gusset panel 50*a* comprises a handle flap 32 and is hinged to a second part of a top end closure panel 53*a* along fold line 84*a*. Together the first and second gusset panels 51*a*, 50*a* form a second part of an end extension panel. When the blank 10 is erected to form the carton 40, the first and second gusset panels 41*a*/42*a* which are hinged to the first top panel 12 and the first and second gusset panels 51*a*/50*a* which are hinged to the second top panel 20 are adhered to one another and thereby form a composite end extension panel 41*a*/42*a*/51*a*/50*a*. Similarly when the blank 10 is constructed into a carton the first part of a top end closure panel 43*a*is adhered to the second part of a top end closure panel 53*a* thereby forming a composite top end closure panel 43*a*/53*a*.

Turning to the construction of the carton 40 from blank 10, a series of sequential folding and gluing operations are required, which preferably can be performed in a straight line machine, so that the carton 40 and/or blank 10 are not required to be rotated or inverted to complete the construction. The folding process is not limited to that described below and can be altered according to particular manufacturing requirements.

Figure 2A:
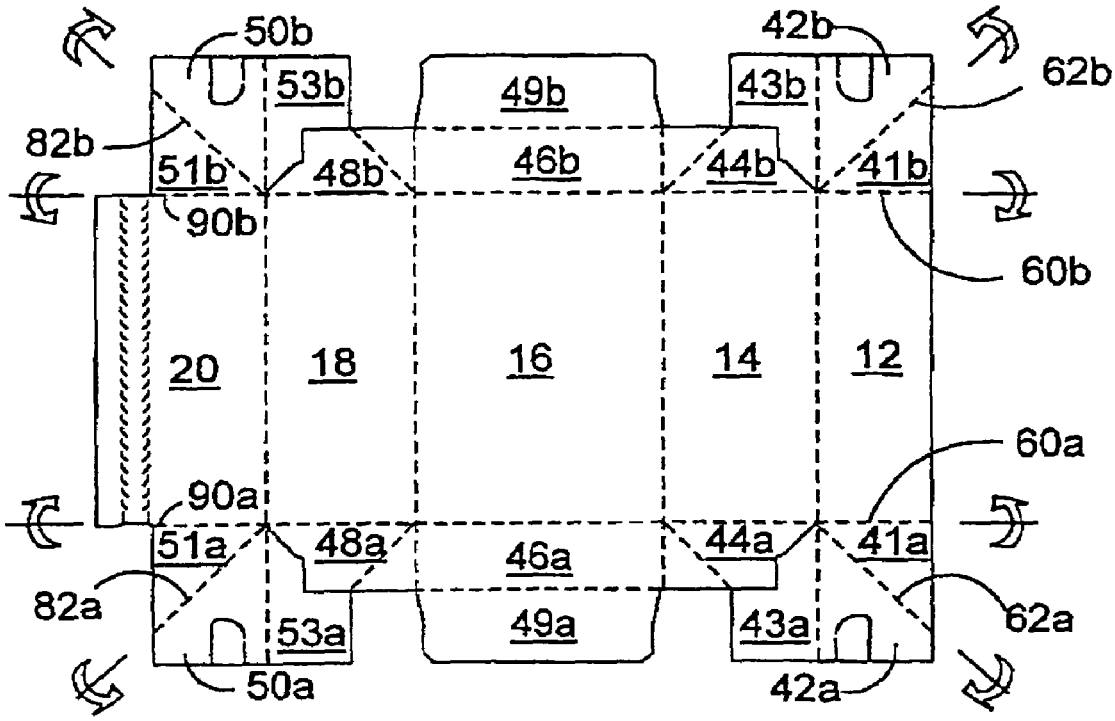
FIG. 2A shows the blank of FIG. 1 in a rotated position in preparation of constructing the blank into a carton.
Figure 2B:
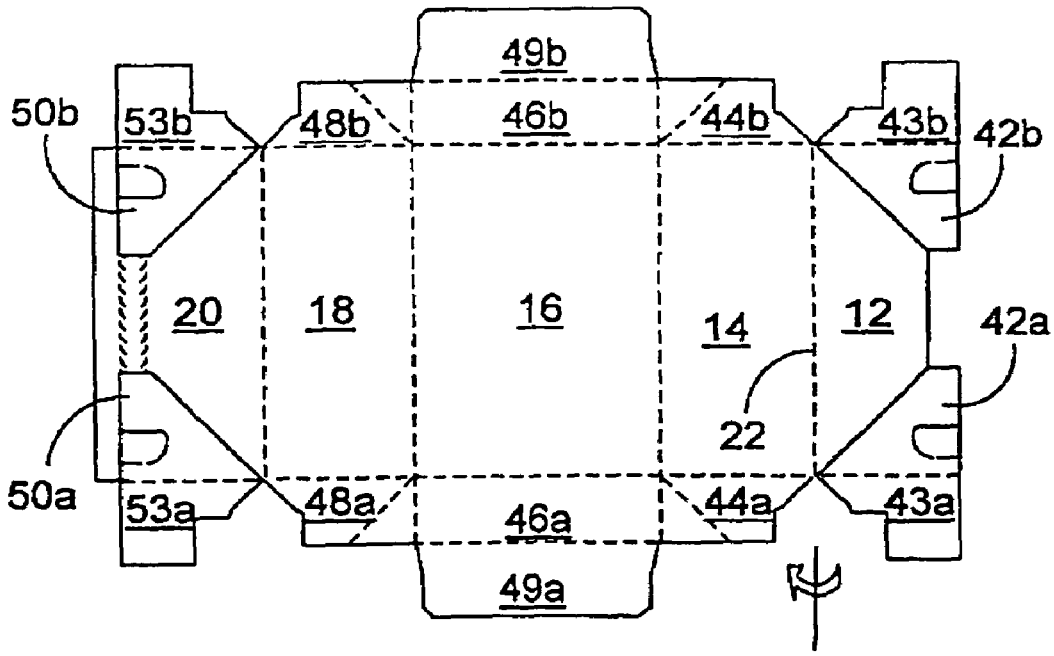
FIG. 2B shows a first step in a folding and gluing sequence for constructing the blank of FIG. 1 into a carton.
Figure 2C:
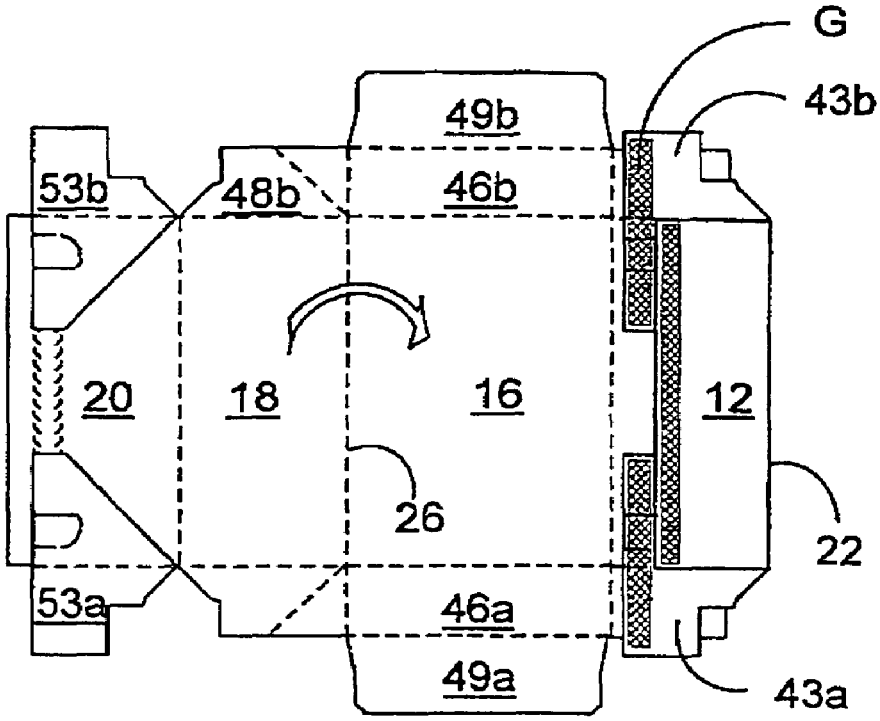
FIG. 2C shows a second step of the folding and gluing sequence for constructing the blank of FIG. 1 into a carton.
Figure 2D:
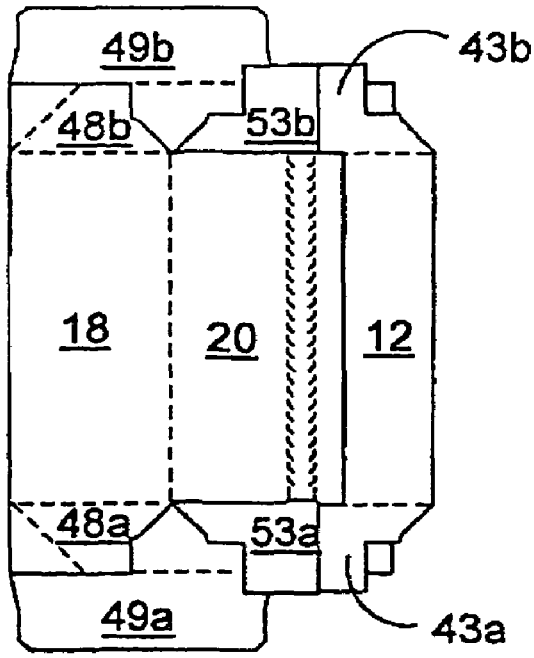
FIG. 2D shows a third step of the folding and gluing sequence for constructing the blank of FIG. 1 into a carton.
Figure 3:
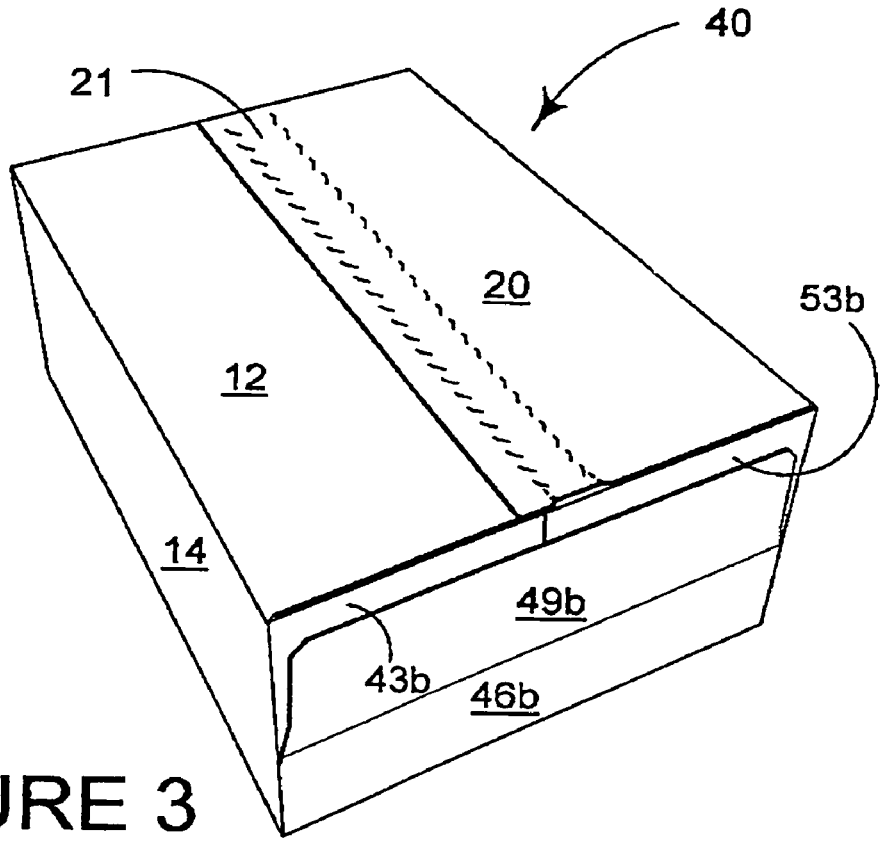
FIG. 3 shows a perspective top, end and side view of the carton constructed from the blank of FIG. 1.

Reference is made to FIGS. 2A-3. In the first stage of the folding and gluing process each of the first gusset panels 41*a*/41*b*, 51*a*/51*b* hinged to the first and second top panels 12, 20 respectively, are folded inward of the top panels 12, 20 about fold lines 60*a*/60*b*, 90*a*/90*b*. The first gusset panels 41*a*/41*b*, 51*a*/51*b* are brought into flat face contact with an inside face of the respective top panel 12, 20 causing the second gusset panels 42*a*/42*b*, 50*a*/50*b* to be automatically folded about the adjoining fold line 62*a*/62*b*, 82*a*/82*b*. Each of the second gusset panels 42*a*/42*b*, 50*a*/50*b* is brought into contact with the adjacent first gusset panel 41*a*/41*b*, 51*a*/51*b*, thereby forming a three ply layer as illustrated in FIG. 2B.

The second stage of the folding process requires the first top panel 12, to be folded 180° about fold line 22 so that the inside face of the first top panel 12, along with the folded gusset panels 41*a*/41*b*, 42*a*/42*b*, contacts the first side panel 14. In this way the outside face of the first top panel 12 is fully visible and the first parts 43*a*/43*b* of top end closure panels extend from beneath the first top panel 12. This is illustrated in FIG. 2C along with the areas of the first top panel 12 and first parts 43*a*/43*b* of top end closure panels where glue is applied.

The second top panel 20, along with the first and second gusset panels 51*a*/51*b*, 50*a*/50*b*, is folded along with the second side panel 18 about fold line 26. The second top panel 20 is brought into overlapping alignment with the first top panel 12 so that the second top panel 20 is secured by the adhesive that has been applied to the first top panel 12. In this way the second gusset panels 42*a*/50*a* and 42*b*/50*b* are secured together to form composite end extension panels 41*a*/42*a*/51*a*/50*a*, 41*b*/42*b*/51*b*/50*b* comprising the handle flaps 30 which are aligned to form a single handle flap in each composite end extension panels 41*a*/42*a*/51*a*/50*a*, 41*b*/42*b*/51*b*/50*b*.

Similarly the second parts of top end closure panels 53*a*/53*b* are adhered to the glued areas of the first parts of top end closure panels 43*a*/43*b*. In this way the first part 43*a* is adhered to the second part 53*a* and together the two parts form a top end closure panel 43*a*/53*a*. Similarly the first part of a top end closure panel 43*b* is adhered to the second part 53*b* to form a second top end closure panel 43*b*/53*b*. After the initial folding and gluing steps the stage illustrated in FIG. 2D is reached. It is envisaged that the blank 10 may be provided in this prepared state and the loading and completion of the construction of the carton may be performed in a different manufacturing location.

To prepare the blank 10 for loading, the composite top wall formed from the first and second top panels 12, 20 may be lifted above the bottom panel 16 and each of the first and second side panels 14, 18 raised above the plane of the bottom panel 16 by folding about fold lines 24 and 26 respectively. The partially completed carton 40 is then ready to be loaded. In this embodiment the carton 40 may be end loaded from either or both ends with beverage containers such as cans (C), in four rows of three cans each. Once the carton 40 is loaded, the composite top end closure panels 43*a*/53*a*, 43*b*/53*b* are folded about fold lines 64*a*/84*a*, 64*b*/84*b*. The side end closure panels 44*a*, 48*a*, 44*b*, 48*b* are also folded inward of the carton 40 about fold lines 66*a*, 80*a*, 66*b*, 80*b*. The intersecting fold lines 68*a*, 78*a*, 68*b*, 78*b*, cause a portion of each of the side end closure panels 44*a*, 48*a*, 44*b*, 48*b* to be folded against the main part of each side end closure panel 44*a*, 48*a*, 44*b*, 48*b* and as a result cause the bottom end closure panels 46*a*/49*a*, 46*b*/49*b* to be folded upward about fold line 72*a*/72*b*. To complete the closing of the ends of the carton 40 glue may be applied to secure the top and side end closure panels 43*a*/53*a*, 43*b*/53*b*, 44*a*, 48*a*, 44*b*, 48*b* to the bottom end closure panels 46*a*/49*a*, 46*b*/49*b*. A loaded and fully constructed carton 40 is shown in FIG. 3.

Figure 5:
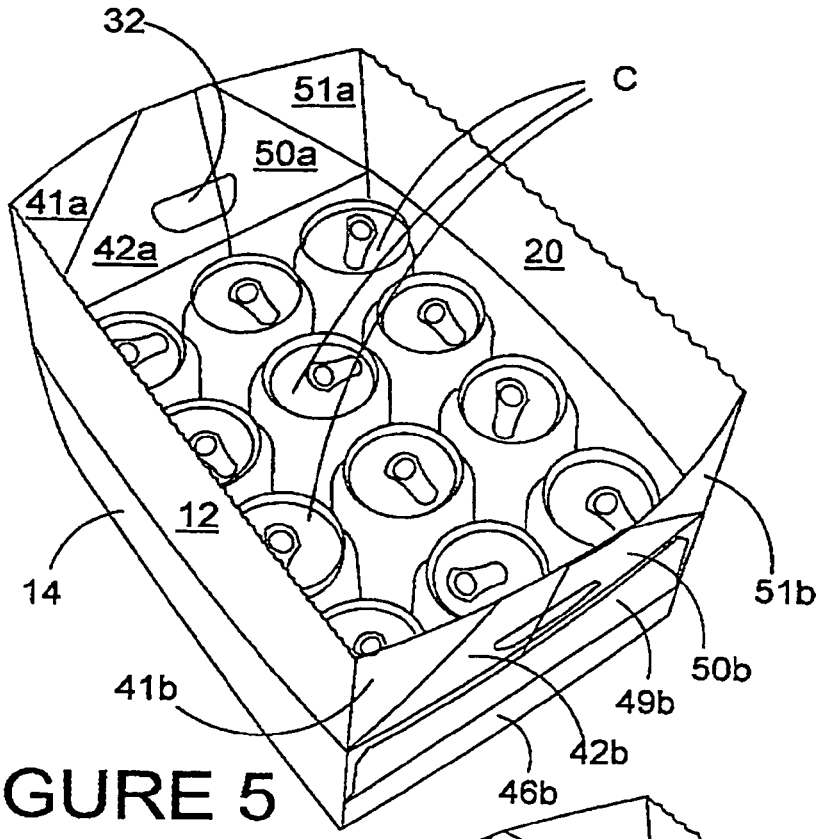
FIG. 5 shows a perspective view of the carton of FIG. 4 with the top completely opened to provided access to the beverage cans contained within the carton.

Access is gained to the cans (C) contained within the carton 40 by removing the tear strip 21 as shown in FIG. 4. Removal of the tear strip 21 allows the first and second top panels 12, 20 to fold open above the tops of the cans (C). The top panels again being folded about folded lines 22 and 28. Similarly the composite handle panels 42*a*/50*a* and 42*b*/50*b* are folded up out of the plane of the surface of the cans (C). The composite end extension panels 41*a*/42*a*/51*a*/50*a* and 41*b*/42*b*/51*b*/50*b* are folded about fold lines 64*a*/84*a* and 64*b*/84*b* respectively. In this way the overall height of the carton is increased with the first and second top panels 12, 20 becoming extensions of the first and second side panels 14, 18 and the composite end extension panels 41*a*/42*a*/51*a*/50*a* and 41*b*/42*b*/51*b*/50*b* becoming extensions of the end closure structures. The opened carton is illustrated in FIG. 5. The extension of the composite end extension panels 41*a*/42*a*/51*a*/50*a* and 41*b*/42*b*/51*b*/50*b* from a stowed position beneath the top panels 12, 20 into a position of use provides a means by which the carton 40 may be carried. The handle flap 30 is defined by a series of interrupted scorelines so that it is yieldable upon the insertion of a users hand or fingers and thereby provides a carrying means for the carton 40.

Figure 6:
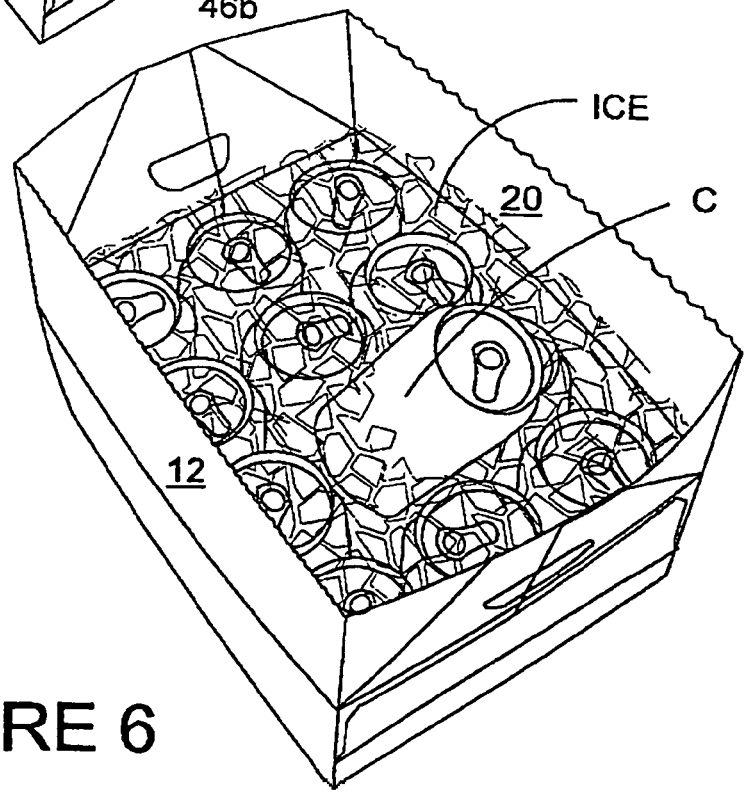
FIG. 6 shows the carton of FIG. 5 after ice cubes have been placed within the carton.

By increasing the height of the carton 40 the capacity of the carton 40 is increased. This allows a consumer or user of the carton to place additional items within the carton 40. It is envisaged that ice cubes may be placed on top of and in between the cans (C) contained within the carton 40. The loading of the carton 40 with ice cubes may facilitate the cooling of the cans (C) however, it is envisaged that other items may be added to the carton 40 which may contain articles other than beverage containers or cans (C) for reasons other than to cool the articles contained within the carton 40. The carton 40 remains transportable once opened and filled with ice cubes. The increased height of the carton 40 side walls and end closures improves the retention of the additional articles placed within the carton. The deployment of the handle flaps 30 facilitates the carrying of the opened carton. The cans (C) are individually removable from the carton 40 as illustrated in FIG. 6.

Figure 7:
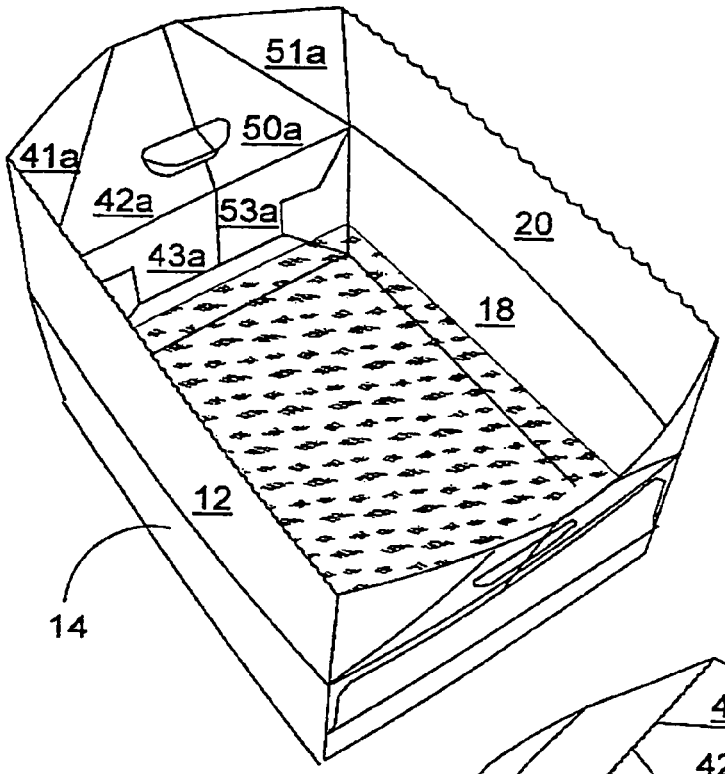
FIG. 7 illustrates the carton of FIG. 5 once the cans have been removed and the ice placed within the carton has melted.
Figure 8:
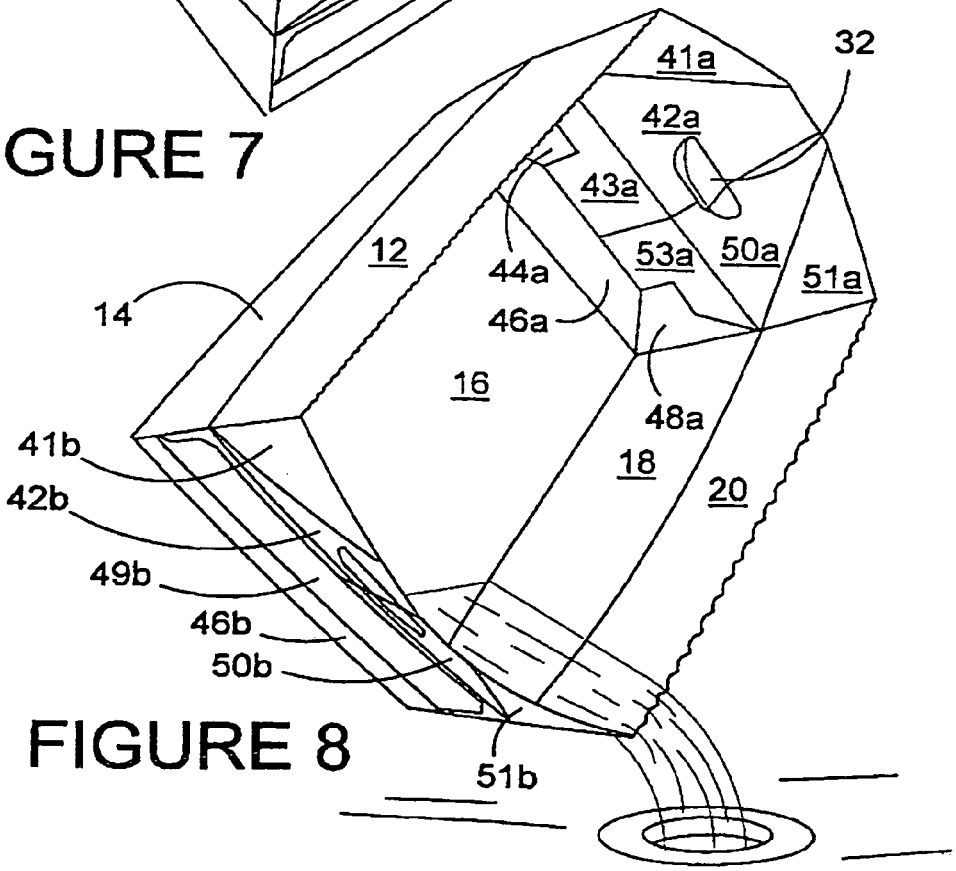
FIG. 8 illustrates water being poured out of the carton of FIG. 7.

The carton 40 is structured and arranged to be substantially water resilient, so that upon the melting of the ice cubes, any water may be contained within the carton 40. This is illustrated in FIG. 7. The water resulting from the melting of ice cubes can be easily contained within the carton 40 and also easily disposed of therefrom as illustrated in FIG. 8.

In other embodiments of the invention it is envisaged that other articles may be contained within the carton and that the invention is not limited to a carton, or a blank for forming a carton, for containing cans arranged in four rows of three and for containing ice-cubes. Accordingly alterations may be made to accommodate other articles. A second embodiment of the invention will now be described wherein like reference numerals are used to depict like features from the first embodiment albeit the reference numerals are raised by a factor of '100' to illustrate that the features belong to the second embodiment.

Figure 9:
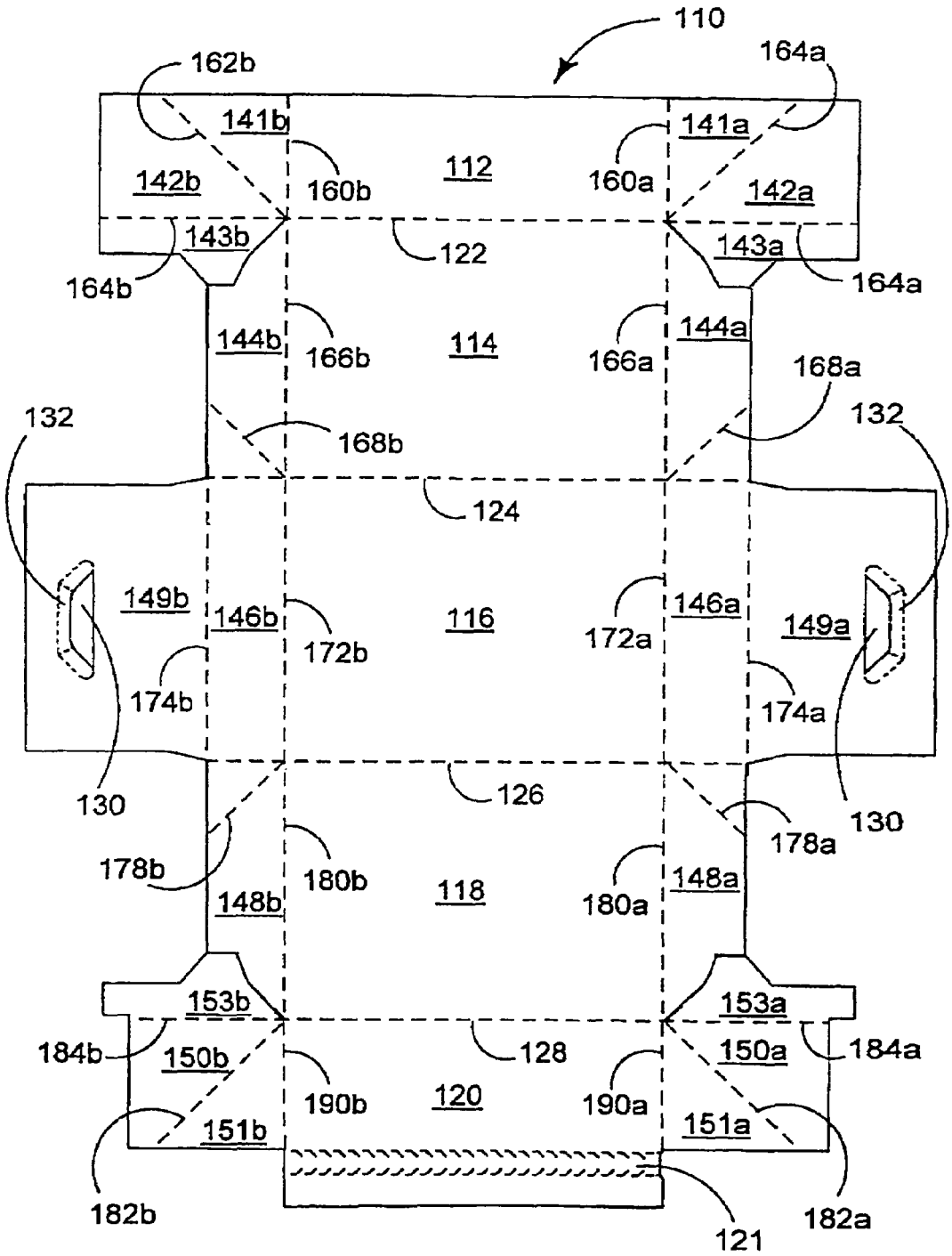
FIG. 9 shows a top plan view of a blank according to a second embodiment, for forming a carton.
Figure 10:
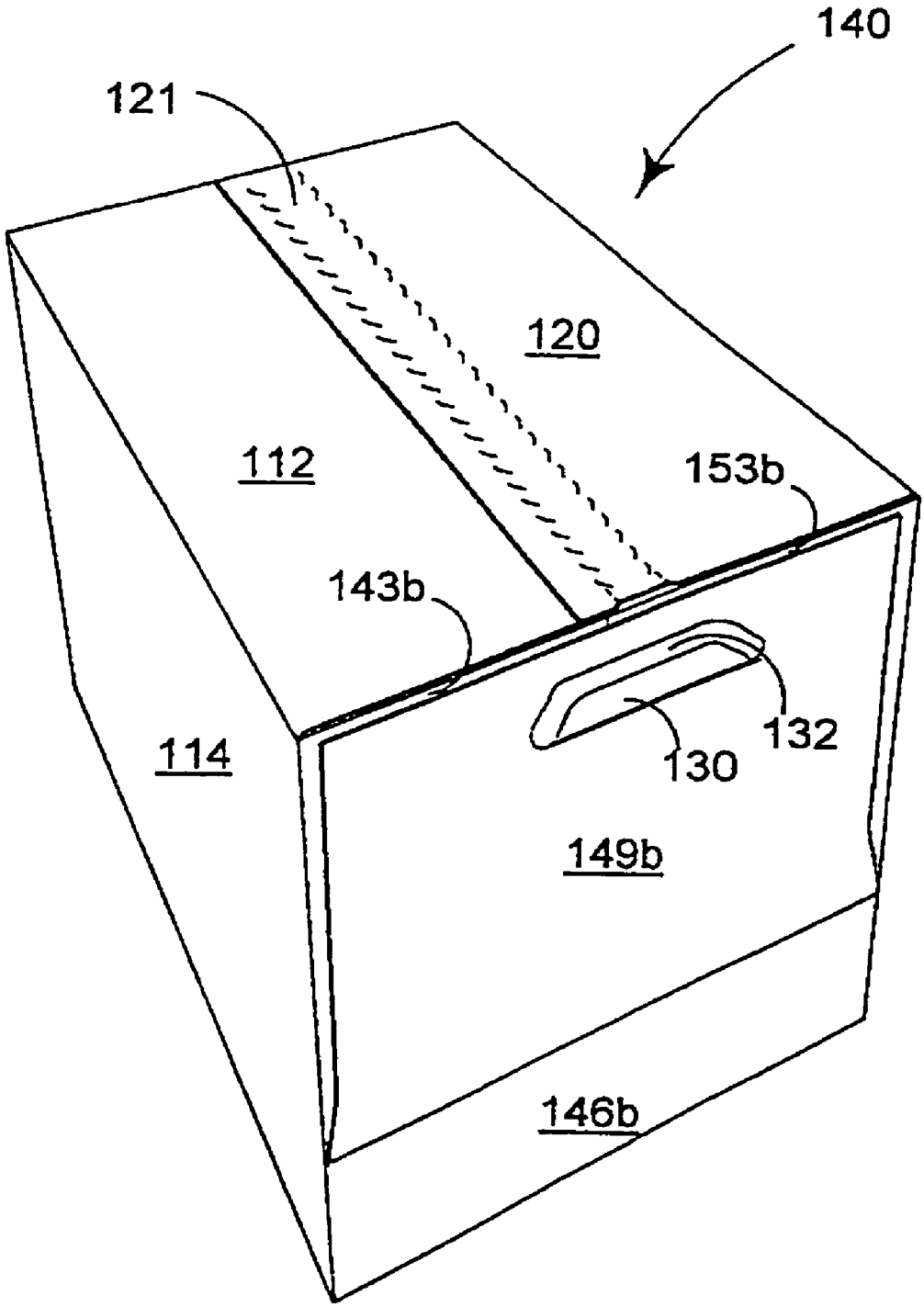
FIG. 10 shows a perspective top, end and side view of the carton formed from the blank shown in FIG. 9.

FIG. 9 shows a blank 110 of the second embodiment which is sized to form a carton for carrying bottles. A two part bottom end closure panel 146*a*/149*a*, 146*b*/149*b* is hinged to each end of a bottom panel 116 along fold lines 172*a*/172*b*. The upper part of each bottom end closure panel 149*a*, 149*b* is provided with a handle aperture 130 comprising handle flaps 132. In this embodiment the second gusset panels 142*a*, 142*b*, 150*a*, 150*b* do not comprise handle flaps, the carrying means being provided in the bottom end closure panels 149*a*, 149*b*. The blank 110 is constructed and loaded using a similar series of folding and gluing steps as herein before described. A carton 140 constructed from the blank 110 is shown in FIG. 10. The handle apertures and handle flaps 130, 132 are provided in a position in which they can be used for carrying an unopened carton 140. Upon opening the carton 140 using the tear strip 121, the height of the carton side and end walls is extended to facilitate the insertion of other items such as ice-cubes into the carton 140.

It can be appreciated that various changes may be made without departing from the scope of the present invention, for example, the size and shape of the panels may be adjusted to accommodate articles of differing size or shape. The handle arrangement may be shaped according to a variety of user requirements. Other variations may also be made within the scope of the invention. For example only one top panel may be required in embodiments where the end extension panels and/or top end closure panels are not formed from two parts but are provided in the carton blank as integral pieces. The single top panel provided may still be separable into two parts to provide extensions to the side walls.

It will be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a score line, a frangible line or a fold line without departing from the scope of the invention.

What is claimed is:

1. A carton of the end loading type for containing a plurality of similar articles and being structured such that the capacity of the carton can be increased when opened, the carton comprising a series of main panels hinged one to the next, including a bottom panel, first and second side panels and at least one top panel, said at least one top panel having a tear strip and thereby being separable into two parts, said at least one top panel being hinged at each end thereof to at least a portion of an end extension panel, the carton further comprising a top end closure panel hinged to each end extension panel and bottom and side end closure panels hinged to opposing ends of the bottom and side panels, characterized in that the end extension panels are disposed beneath said at least one top panel and in that separating said at least one top panel, by deploying the tear strip, allows each end extension panel to be raised into substantially the same plane as the respective adjacent top end closure panel and further allows each of the separated parts of said at least one top panel to be raised into substantially the same plane as the respective adjacent side panel, thereby increasing the capacity of the open carton, wherein a handle aperture is formed in each end extension panel for carrying the opened carton.

2. A carton according to claim 1 wherein said at least one top panel comprises two top panels, the two top panels being hinged to the side panels respectively.

3. A carton according to claim 1 wherein each end extension panel comprises first and second separate portions secured together to form said each end extension panel.

4. A carton according to claim 3 wherein each end extension panel is hinged to the respective top end closure panel.

5. A carton according to claim 4 wherein each top end closure panel is formed from two portions.

6. A carton according to claim 1 formed from a sheet material, one side of which being coated with a water resilient coating.

7. A carton of the end loading type for containing a plurality of similar articles and being structured such that the capacity of the carton can be increased when opened, the carton comprising a series of main panels hinged one to the next, including a bottom panel, first and second side panels and at least one top panel, said at least one top panel having a tear strip and thereby being separable into two parts, said at least one top panel being hinged at each end thereof to at least a portion of an end extension panel, the carton further comprising a top end closure panel hinged to each end extension panel and bottom and side end closure panels hinged to opposing ends of the bottom and side panels, characterized in that the end extension panels are disposed beneath said at least one top panel and in that separating said at least one top panel, by deploying the tear strip, allows each end extension panel to be raised into substantially the same plane as the respective adjacent top end closure panel and further allows each of the separated parts of said at least one top panel to be raised into substantially the same plane as the respective adjacent side panel, thereby increasing the capacity of the open carton, wherein each bottom end closure panel comprises a handle aperture for carrying the carton.

8. A blank for forming a carton of the end loading type, the carton for containing a plurality of similar articles and being structured such that the capacity of the carton can be increased when opened, the blank comprising a series of main panels hinged one to the next, including a bottom panel, first and second side panels and at least one top panel, said at least one top panel having a tear strip and thereby being separable into two parts, said at least one top panel being hinged at each end thereof to at least a portion of an end extension panel, the blank further comprising a top end closure panel hinged to each end extension panel and bottom and side end closure panels hinged to opposing ends of the bottom and side panels, characterized in that the end extension panels are disposed beneath said at least one top panel when the carton is set up and in that separating said at least one top panel, by deploying the tear strip, allows each end extension panel and each of the separated parts of said at least one top panel to be raised into substantially the same plane as respective adjacent side and end walls, thereby increasing the capacity of the open carton.

9. A blank according to claim 8 wherein said at least one top panel comprises two top panels, said two top panels being hinged to the side panels respectively.

10. A blank according to claim 9 wherein each end of each of said top panels is hinged to a portion of an end extension panel wherein upon constructing the blank into a set up carton each portion is secured to a second portion to form two composite end extension panels.

11. A blank according to claim 10 wherein each portion of the end extension panel is hinged to a portion of a top end closure panel wherein upon constructing the blank into a set up carton each portion of the top end closure panels is secured to a second of said portions to form two composite top end closure panels.

12. A blank according to claim 8 further comprising a handle aperture in each end extension panel for carrying the opened carton.

13. A blank according to claim 8 wherein each bottom end closure panel comprises a handle aperture for carrying a set up carton.

14. A blank according to claim 8 wherein one side of the blank is coated with a water resilient coating.

* * * * *